United States Patent [19]

McCredie

[11] Patent Number: 4,838,824

[45] Date of Patent: Jun. 13, 1989

[54] SWIMMING FLIPPER

[76] Inventor: Donald B. McCredie, 3/28 Carr Street, Coogee, New South Wales, Australia

[21] Appl. No.: 118,218

[22] Filed: Nov. 6, 1987

[51] Int. Cl.[4] ..... A63B 31/12

[52] U.S. Cl. ..... 441/64; D21/239

[58] Field of Search ..... 441/61, 64, 55; 272/93, 272/96, 71, 114; D21/239, 238, 237, 236, 199, 191

[56] References Cited

U.S. PATENT DOCUMENTS 3,810,269 5/1974 Tabata ..... 441/64
3,940,815 3/1976 Hill ..... 441/64
3,978,537 9/1976 Shamlian ..... 441/64
4,025,977 5/1977 Cronin ..... 441/64

*Primary Examiner*—Sherman D. Basinger
*Assistant Examiner*—Clifford T. Bartz
*Attorney, Agent, or Firm*—Hamilton, Brook, Smith & Reynolds

[57] ABSTRACT

A swimming flipper is disclosed with two opposed rails on each side of flipper extending outwardly and at an angle to the plane of the flipper surface. The flipper surface may also be provided with a number of stepped segments such that the thickness of the flipper portion increases from the front edge of the flipper towards the toe portion.

8 Claims, 2 Drawing Sheets

SWIMMING FLIPPER

FIELD OF THE INVENTION

The present invention relates to a swimming flipper for use in bodysurfing and bodyboarding.

BACKGROUND OF THE INVENTION

Flippers are commonly used to provide extra kicking power for the wearer when swimming and, as such, are widely used in water sports such as skin diving and bodysurfing.

An important factor in successful bodysurfing or bodyboarding is the ability, when riding a hollow wave, to maintain traction on the wave wall and allow the surfer to maintain his position in the critical section of the wave. The critical section of wave being that area of the wave which propels the surfer forward without the wave "breaking" on top of him or allowing him to be thrown out of the curl of the wave. The power and control provided by flippers as extensions of the feet enable the bodysurfer to control accurately his position in relation to the wave and thus stay within this critical section.

Known flippers are usually substantially flat rubber flaps which extend from a shoe portion and thus magnify the kicking effect of the wearer by increasing the area of water displaced by each kick of the feet. However it has been found this effect is somewhat reduced by the escape of displaced water over each side of the flipper surface both during upward and downward movement thereof. Furthermore, the control of direction necessary in bodysurfing applications is reduced by only four control "edges" being provided on each flipper.

It is an object of the present invention to increase the efficiency of known flippers by reducing water displacement losses and to give improved control by providing a larger number of control surfaces or "edges" to each flipper.

SUMMARY OF THE INVENTION

According to one aspect, the invention provides a swimming flipper comprising a shoe portion and a flipper portion extending therefrom, said flipper portion having provided on each longitudinal edge thereof at least two opposed rails extending outwardly and at an angle to the plane of said flipper portion. The rails diverge away from each other and define between them a re-entrant angle.

For preference, said rails extend substantially the length of each longitudinal edge of said flipper portion. Preferably, a substantially upright fin member is provided on the upper and lower surface of the flipper portion or both surfaces thereof. Said fin member preferably extends longitudinally along the mid line of the said flipper portion.

According to a further aspect, the invention resides in a swimming flipper having, on at least one surface portion, a plurality of stepped segments such that the thickness of said flipper portion increases from the front thereof towards said shoe portion and are arranged in a chevron pattern.

In one preferred form, said flipper is heat injection molded from rubber or plastic material, so as to provide a durable, resilient and flexible device.

In a further preferred form, the shoe portion of the swimming flipper is made more flexible than the flipper portion so as to provide comfort to the wearer without loss of propulsion efficiency.

DETAILED DESCRIPTION OF THE INVENTION

Figure 5:
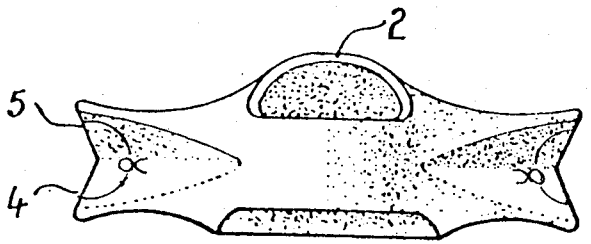
FIG. 5 is a rear elevational view of the flipper of FIG. 1.
Figure 6:
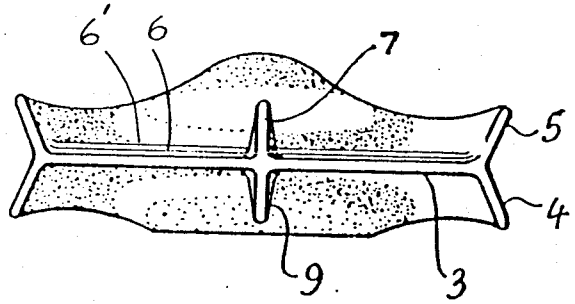
FIG. 6 is a front elevational view of the flipper of FIG. 1.

Referring to the drawings, there will be seen a swimming flipper 1 comprising a shoe portion 8 and flipper portion 3. Each longitudinal side of the flipper portion 3 has a pair of rails 4 and 5 provided thereon. These rails extend outwardly from the flipper portion 3. They diverge away from each other and define between them an inward or re-entrant angle $\alpha$ as shown in FIGS. 5 and 6.

The shoe portion 8 is provided with an entrance hole 2 which enables the foot of the wearer to be inserted into a cavity in the shoe portion 8.

The flipper is further provided with upright or vertical fins 7 and 9 extending respectively from the upper and lower surfaces of the flipper portion 3 and extend longitudinally along the mid-line of said flipper portion. These fins act to provide further directional control to the wearer.

Figure 3:
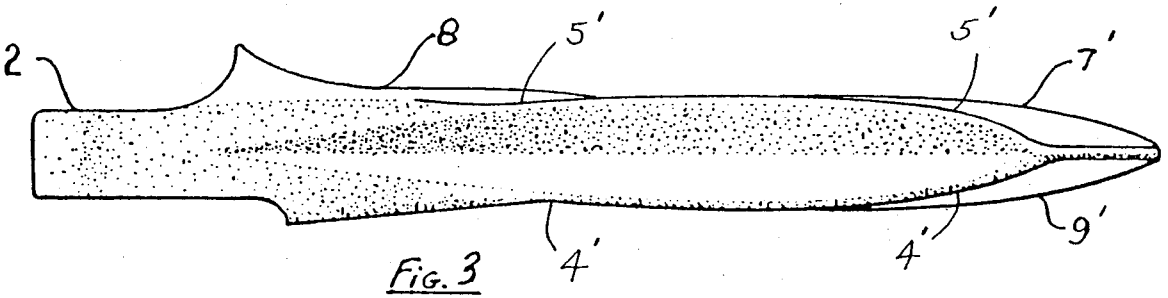
FIG. 3 is a side elevational view of the flipper of FIG. 1.
Figure 4:
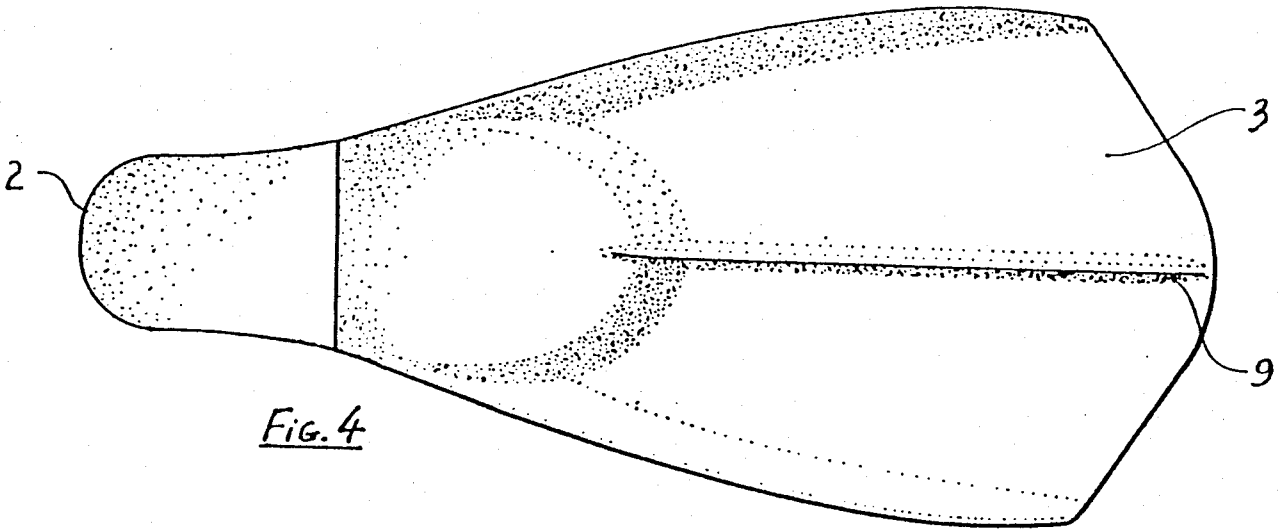
FIG. 4 is an underside view of the flipper of FIG. 1.

The side rails 4 and 5 and the upright or vertical fins 7 and 9 are preferably tapered towards the front and rear of the flipper while broadening out towards the center of the flipper portion edges. This shown in FIG. 3 at areas 4' and 5' and 7' and 9'. Furthermore, the rails 4 and 5 and fins 7 and 9 are molded so as to smoothly merge into the shoe portion 8 of the flipper so as to minimize frictional forces.

Figure 1:
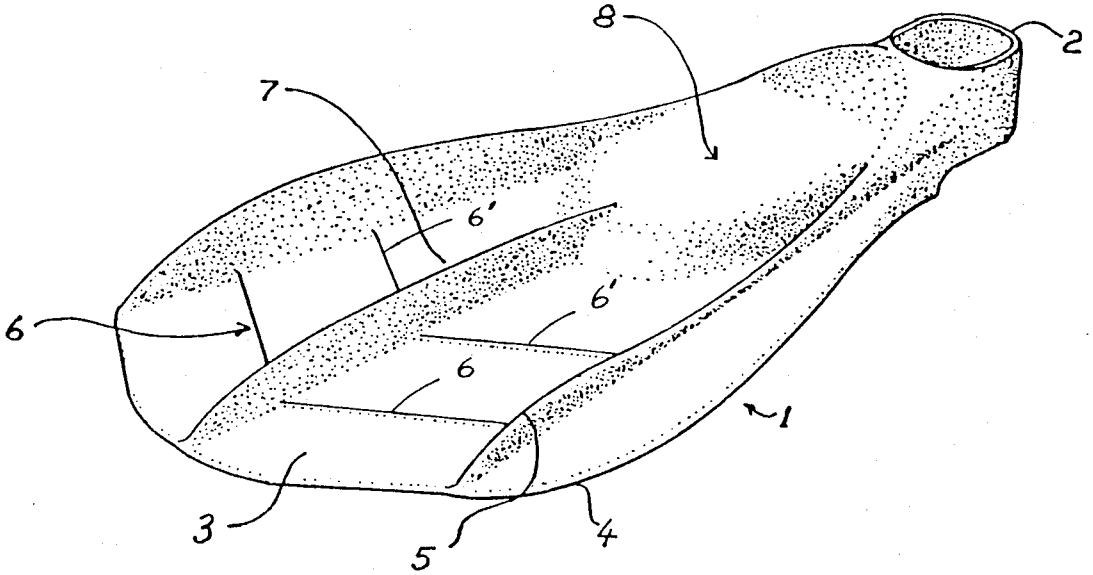
FIG. 1 is a perspective view of a swimming flipper made according to the invention.
Figure 2:
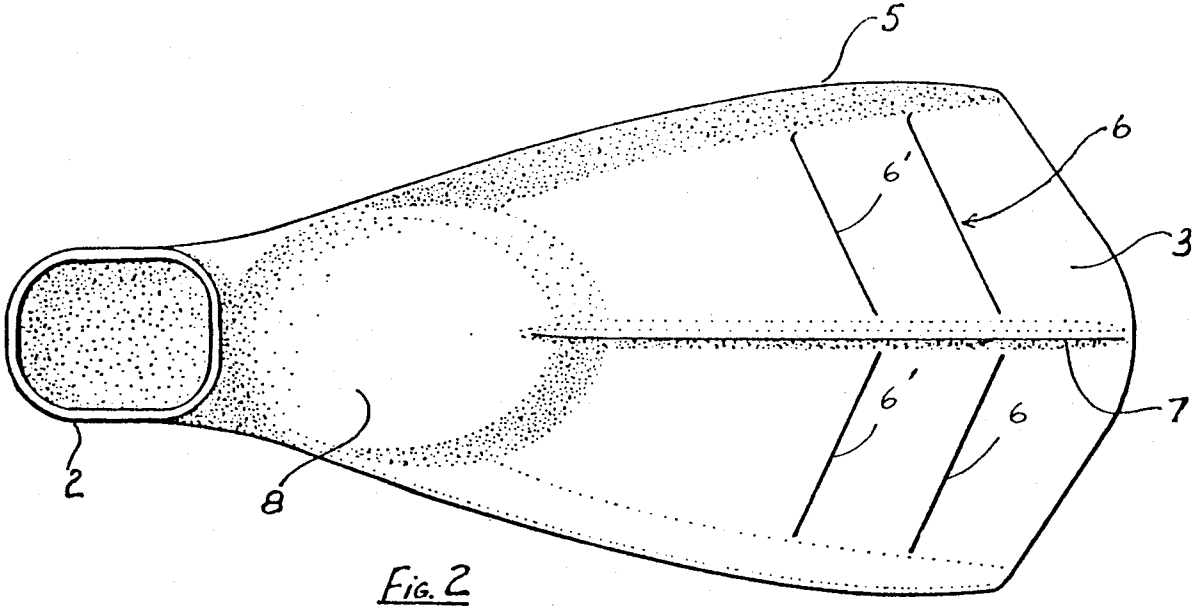
FIG. 2 is a plan view of the flipper shown in FIG. 1.

To provide a further scooping effect and increased traction with the waves during bodysurfing, the upper surface of the flipper portion, is provided with a series of stepped segments 6 and 6' (see FIG. 6,) which angularly intersect each other at an obtuse angle (FIG. 3) and are arranged in a chevron pattern (FIG. 2) such that the thickness of the flipper portion 3 is increased in stepped stages from the front of the flipper towards the shoe portion 8. This stepping may also be provided on the undersurface if desired.

In use, the side rails 4 and 5 channel the displaced water towards the front of the flipper during both upward and downward movement of the flipper. This channelling effect reduces the loss of displaced water over each side of the flipper surface and increases the forward propulsive force provided during kicking by the wearer.

The side rails channel the displaced water towards the front of the flipper during both upward and downward movement of the flipper. This channelling effect reduces the loss of displaced water over each side of the flipper surface and increases the forward propulsive force provided during kicking by the wearer.

The side rails 4 and 5 and the central fins 7 and 9 further provided increased directional control by increasing the number of surfaces or edges engaging the water and thus provide the wearer with the ability to use his feet to create a "rudder like" effect when being propelled forward by a wave.

The stepped surfaces 6 and 6' of the flipper portion 3, in use, provide increased resistance to slippage of water over the surface of the flipper and thus increases the displacement of water during each kick by the wearer. This increases water displacement results in improved propulsion efficiency.

It will be apparent to those skilled in the art that the invention is not limited to the specific embodiments described and further embodiments and exemplifications of the invention are possible without departing from the spirit or scope of the invention described.

I claim:

1. A swimming flipper comprising a shoe portion and a flipper portion extending therefrom, said flipper portion having a longitudinal midline substantially along which a fin member extends, said flipper portion having provided on each longitudinal edge thereof two opposed rails extending outwardly and diverging away from each other and defining between them a re-entrant angle along the edges of said flipper portion, the edges of the two divergent rails being equidistant from the midline and defining the widest part of the flipper portion measured from the midline.

2. A swimming flipper according to claim 1 wherein said rails extending substantially the length of each longitudinal edge of said flipper portion.

3. A swimming flipper according to claim 1 wherein said flipper portion has an upper and lower surface and whereupon either one or both surfaces is provided with a substantially upright fin member.

4. A swimming flipper according to claim 1 wherein the opposed rails are tapered towards the flipper's front and rear ends while broadening out towards substantially the center of the flipper portion edges.

5. A swimming flipper according to claim 1 wherein said rails merge smoothly into the foot portion of the flipper to minimize frictional forces.

6. A swimming flipper comprising a shoe portion and a flipper portion extending therefrom, the flipper portion having a plurality of parallel stepped segments which are arranged in a chevron pattern such that the thickness of said flipper portion increases from the front thereof towards said shoe portion.

7. A swimming flipper according to claim 6 wherein said stepped segments are provided on one of the upper or lower surfaces of said flipper portion.

8. A swimming flipper according to claim 6 wherein said stepped segments are provided on both upper and lower surfaces of the flipper portion.

* * * * *